US005498143A

United States Patent [19]

Dreiman et al.

[11] Patent Number: 5,498,143

[45] Date of Patent: Mar. 12, 1996

[54] SCROLL COMPRESSOR WITH FLYWHEEL

[75] Inventors: Nelik I. Dreiman, Tipton; Hubert Richardson, Jr., Brooklyn, both of Mich.

[73] Assignee: Tecumseh Products Company, Tecumseh, Mich.

[21] Appl. No.: 356,145

[22] Filed: Dec. 15, 1994

[51] Int. Cl.[6] ..... F04B 35/04; F04C 18/04; F04C 29/02

[52] U.S. Cl. ..... 418/55.1; 418/55.6; 74/572; 417/410.5; 184/6.18; 310/74

[58] Field of Search ..... 418/55.1, 55.6, 418/94, 270; 417/410.5; 184/6.18; 74/572; 310/74

[56] References Cited

U.S. PATENT DOCUMENTS

| | | | |
|---|---|---|---|
| 4,820,130 | 4/1989 | Eber et al. | 417/32 |
| 4,998,864 | 3/1991 | Muir | 417/410.5 |
| 5,064,356 | 11/1991 | Horn | 417/410.5 |
| 5,131,828 | 7/1992 | Richardson | 418/55.3 |
| 5,219,281 | 6/1993 | Caillat et al. | 418/55.6 |

FOREIGN PATENT DOCUMENTS

| | | |
|---|---|---|
| 0537884 | 4/1993 | European Pat. Off. . |
| 486192 | 5/1938 | United Kingdom . |

*Primary Examiner*—John J. Vrablik
*Attorney, Agent, or Firm*—Baker & Daniels

[57] ABSTRACT

A scroll compressor including a flywheel attached to the rotor of the motor. The flywheel prevents reverse rotation of the orbiting scroll during current interruption or normal compressor shutdown. Additionally, the flywheel prevents destruction of the oil in oil sump around the lubrication oil pick up.

16 Claims, 2 Drawing Sheets

SCROLL COMPRESSOR WITH FLYWHEEL

BACKGROUND OF THE INVENTION

The present invention relates generally to a scroll compressor and more particularly to such a compressor having a flywheel to prevent reverse scroll rotation.

Optimal efficiency and low noise operation of a scroll compressor is highly dependent on the contact forces between the mating scrolls, with the obvious design compromise being to provide enough force to ensure good sealing while generating minimal frictional force components.

Axial and radial sealing are the most critical techniques and have been recognized by U.S. Pat. No. 801,182 which recommended forcing the orbiting scroll axially to the fixed scroll by means of a mechanical spring.

Tip-to-base loading associated with axial compliance can be maintained also by gas loading of the orbiting scroll. Gas pressure is applied underneath of the orbiting scroll to load it against the fixed scroll. Biasing pressure may be provided by discharge gas supplied to the cavity located underneath of the orbiting scroll from the discharge plenum of the scroll compressor or by forming on the back of the orbiting scroll a so-called back pressure chamber with intermediate gas pressure tapped from the compression pockets through vents in the orbiting scroll baseplate. Very often a combination of gas and spring axial loading systems are used in scroll compressors.

The radial compliance techniques described in U.S. Pat. No. 1,906,142 and U.K. Patent No. 486,192 employ the centrifugal force of the rotating parts to produce the radial component from the pressure load by a mechanism such as the swing link. Radial compliance is related to the ability of the orbiting scroll to seek its own orbit path as defined by the wrap geometry in order to maintain outward flank contact. Flank contact is ensured if the centrifugal force of the orbiting scroll mass is sufficient to overcome the radial internal gas forces. A scroll compressor designed for operation at a constant speed cannot be operated at variable speed when only a moderate contact pressure between the orbiting scroll member and stationary scroll member is obtained for a specific rotation speed.

The centrifugal force acting on an orbiting scroll member is reduced from the design level when the rotation speed has come down below the design rotational speed. This undesirable situation permits the orbiting scroll wrap to oscillate on the stationary scroll wrap forming a large radial gap between both scroll wraps, so as to allow the gas under compression to leak to the low pressure side. A following change of the intermediate and discharge gas pressure will effect the axial gas load on the back of the orbiting scroll. This fluctuating, decreasing pressure will trigger upward-downward movement of the orbiting scroll causing impacts of the orbiting scroll tips against the base of the stationary scroll and consequently extensive noise.

Almost the same phenomena can occur after a split-second power interruption or at shut-down of a normal run cycle. The consequence of a split-second interruption is backward rotation of the compressor motor rotor, crankshaft, and attached orbiting scroll. When the power is restored after a split-second interruption, the compressor may continue to run in reverse for several minutes with noticeable noise, until the internal motor protector trips.

At shut-down of a normal run cycle, the compressor will run backward for several seconds with extensive sound and vibration until internal pressures equalize. As disclosed in U.S. Pat. No. 4,998,864, some scroll compressors incorporate a clutch coupled to the drive shaft which permits rotation in only one direction. The clutch rollers are designed with a wedge angle that enable them to engage into the clutching component when reverse rotation occurs. Performing as a roller bearing when orbiting scroll rotates in the normal "forward" direction, the clutch contributes to energy losses, wear of the crankshaft, and additional vibration.

SUMMARY OF THE INVENTION

The object of the present invention is to provide a scroll compressor in which, under application of variable or extraordinary loads, due to, for example, liquid compression, or due to shut-down of the normal run cycle, or interruption of the power, the orbiting scroll continues to orbit in the same predetermined design direction.

According to the present invention there is provided a specially designed flywheel preferably attached to the rotor of the scroll compressor motor.

An advantage of the present invention is that the flywheel attached to the rotor prevents reverse rotation of the scroll during shutdown or on interruption of the input power. Because of the flywheel, the crankshaft continues to cause the orbiting scroll to orbit in the same predetermined design direction.

Yet another advantage of the present invention is that the flywheel aids in removal of heat from the motor by directing the a mixture of discharge pressure gas and oil flowing through the air gap between the rotor and stator toward the motor stator windings.

A further advantage of the present invention is that the flywheel surfaces help to protect oil in the sump from blowing upward and around the oil pickup tube because discharge gas flow is guided toward the inner wall of the housing rather than directly toward the oil sump.

Another advantage of the present invention is that pressure equalization within the compressor at shutdown occurs gradually with no increase in compressor noise. Sudden reductions in axial and radial forces are prevented.

The invention, in one form thereof, comprises a housing in which a motor scroll compressor unit is disposed within the housing. The motor scroll compressor unit includes an orbiting scroll member, a crankshaft/rotor assembly and a stator. The crankshaft/rotor assembly is drivingly connected to the orbiting scroll member which has a particular orbiting direction during operation. A flywheel is attached to the crankshaft/rotor assembly preventing the orbiting scroll member from orbiting during compressor shutdown in a direction opposite to its particular orbiting direction during operation. The flywheel is of sufficient mass to cause pressure equalization within the motor scroll compressor unit to occur gradually on compressor shutdown and to prevent auto rotation of the scroll compressor unit during intermittent power interruptions.

The invention, in another form thereof, comprises a housing in which a motor scroll compressor unit including an orbiting scroll member rotor and stator is disposed. The rotor is drivingly connected to the orbiting scroll member and disposed within the stator defining an air gap. The orbiting scroll member has a particular orbiting direction during operation. The stator includes a bottom surface with an outer radial edge. The motor scroll compressor unit causes fluid to flow through the air gap. An oil sump, containing oil, is disposed within the housing and the rotor and stators spaced apart from the oil. A flywheel is attached to the rotor to prevent the orbiting scroll member from orbiting during compressor shutdown in a direction opposite to its particular orbiting direction and, the flywheel prevents direct flow of fluid through the air gap to the oil sump.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
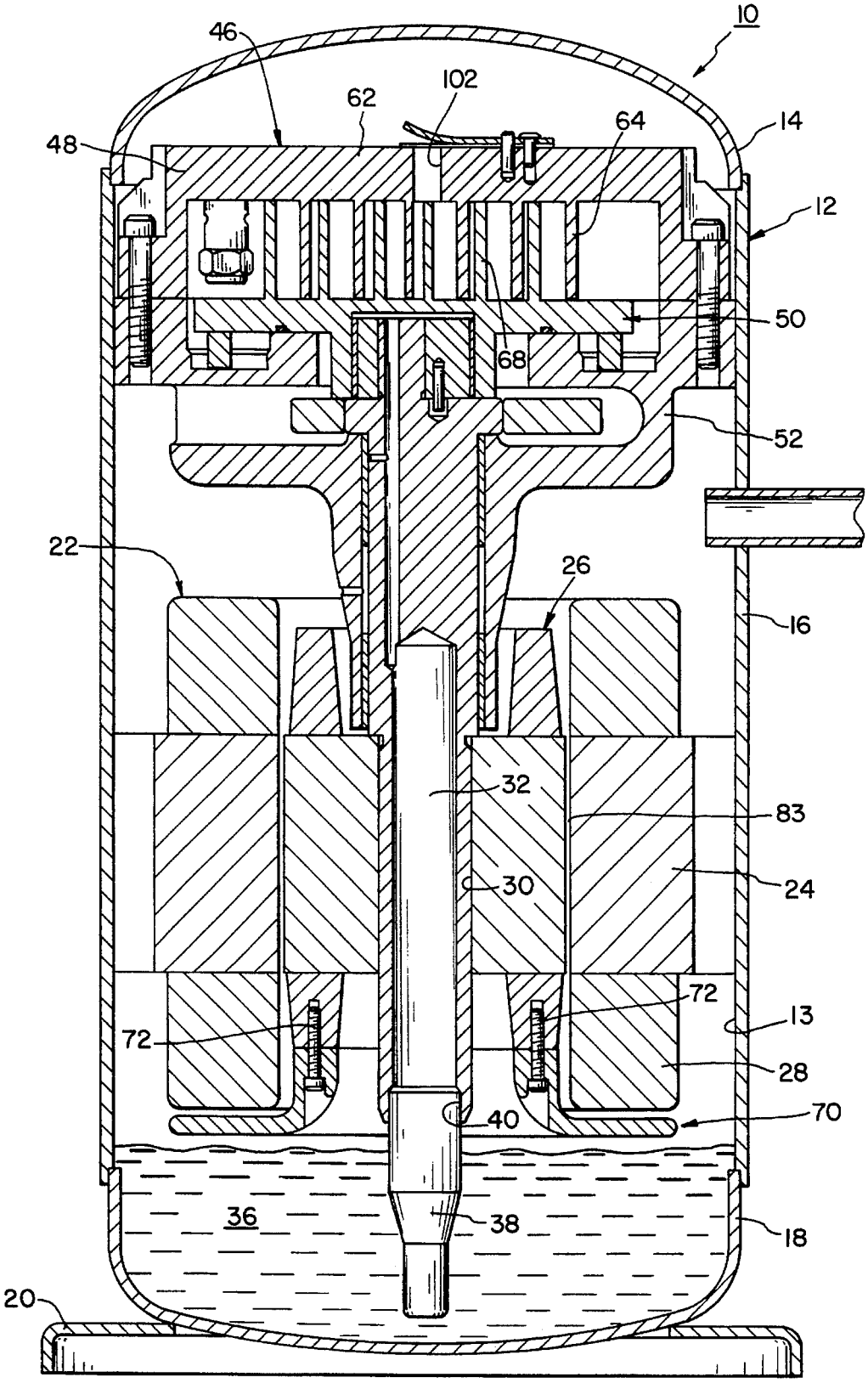
FIG. 1 is sectional view of a scroll compressor to which the present invention pertains.
Figure 2:
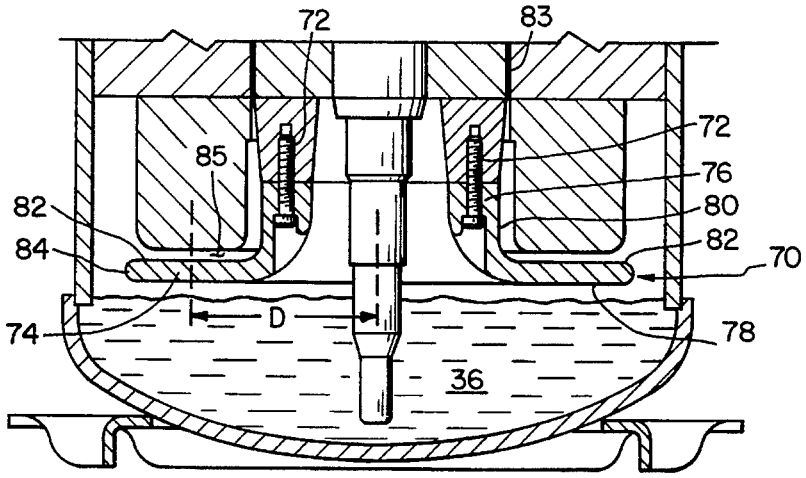
FIG. 2 is an enlarged fragmentary sectional view of the compressor of FIG. 1.
Figure 3:
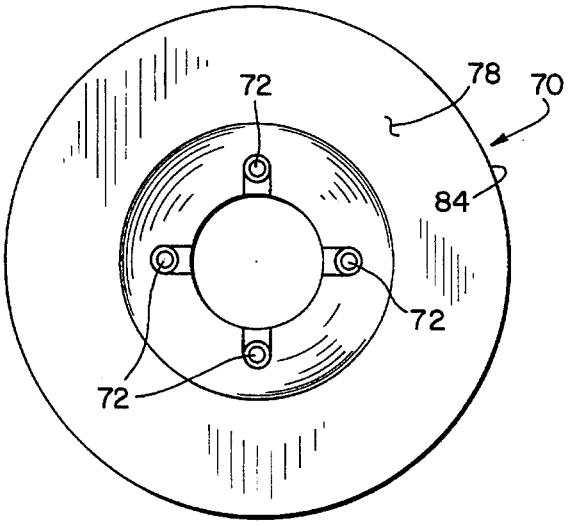
FIG. 3 is a bottom plan view of the flywheel of one form of the present invention.
Figure 4:
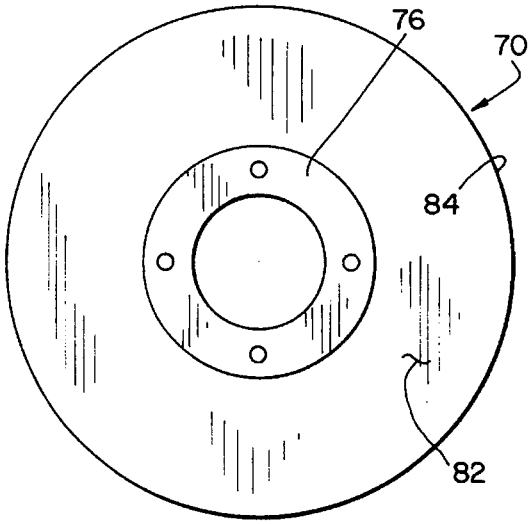
FIG. 4 is a top plan view of the flywheel of one form of the present invention.
Figure 5:
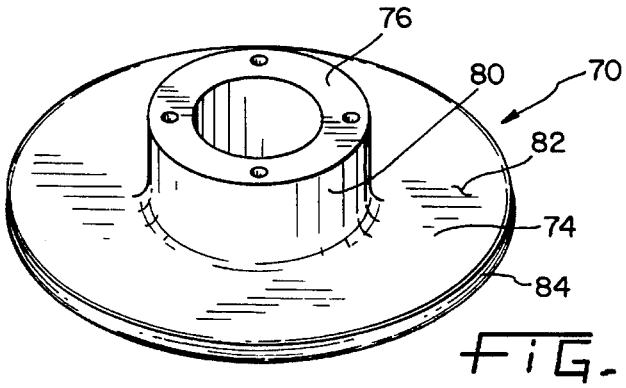
FIG. 5 is a perspective view of the flywheel of one form of the present invention.

In an exemplary embodiment of the invention as shown in the drawings, and in particular by referring to FIGS. 1 and 2, a compressor 10 is shown having a housing generally designated at 12 having an inside wall 13. The housing has a top cover portion 14, a central portion 16, and a bottom portion 18, wherein central portion 16 and bottom portion 18 may alternatively comprise a unitary shell member. The three housing portions are hermetically secured together as by welding or brazing. A mounting bracket 20 is welded to bottom portion 18 for mounting the compressor in a vertically upright position. Located within hermetically sealed housing 12 is an electric motor generally designed at 22, having a stator 24 and a rotor 26. Stator 24 is secured within central portion 16 of the housing by an interference fit such as by shrink fitting, and is provided with windings 28. Rotor 26 has a central aperture 30 provided therein into which is secured a crankshaft 32 by an interference fit.

Compressor 10 also includes an oil sump 36 generally located in bottom portion 18. A centrifugal oil pickup tube 38 is press fit into a counterbore 40 in the lower end of crankshaft 32. Oil pickup tube 38 is of conventional construction and includes a vertical paddle (not shown) enclosed therein. A more thorough description of a typical scroll compressor may be found in U.S. Pat. No. 5,131,828 hereby incorporated by reference.

Compressor 10 further includes a scroll compressor mechanism 46 enclosed within housing 12. Compressor mechanism 46 generally comprises a fixed scroll member 48, an orbiting scroll member 50, and a main bearing frame member 52. Each scroll member includes a scroll wrap 64 and 68 respectively. Fixed scroll member 48 and orbiting scroll member 50 are assembled together so that the wraps operatively interfit with each other.

As shown in the drawings and most clearly in FIG. 2, a specially designed flywheel 70 attached to rotor 26 by means of bolts 72. As shown in drawings 3–5, flywheel 70 is of an annular hub shape having a flat circular bottom plate portion 74 and an upstanding annular attachment portion 76. Bottom plate portion 74 has a lower bottom surface 78 opposite oil sump 36. Attachment portion 76 includes an outer surface 80 that merges with top surface 82 of bottom plate 74. Bottom plate 74 also includes an outer radial edge 84. Flywheel 70 maintains the angular velocity of rotor 26, crankshaft 30, and orbiting scroll 50 at a more constant speed due to its inertia. Further, during operation, flywheel 70 absorbs energy when there is an excess of work output and releases energy when there is a deficiency of work output.

The useable energy of flywheel 70 is in the form of kinetic energy which helps to reduce fluctuation of the rotation speed of crankshaft 32 and thereby the orbit speed of orbiting scroll member 50. By varying the size and weight of flywheel 70 the amount of fluctuation and speed can be kept within any desired practical limits. By its actions, flywheel 70 makes it possible for crankshaft 32 to revolve orbiting scroll 50 in a preferred design direction such as forward and deliver power at an almost constant rate for some time after power interruption or shutdown of the normal run cycle of the compressor has occurred. During compressor shutdown, the rotational speed of the orbiting scroll 50 decreases gradually due to opposition by flywheel 70 inertia. By this operation, the process of pressure equalization between the discharge and suction sides of the scroll compressor unit 46 will be gradual. Such a process of pressure equalization prevents sudden reduction of axial and radial forces on the orbiting scroll 50 preventing formation of a wide radial gap between the orbiting scroll 50 and stationary scroll 49. Additionally, noise and vibrations will be reduced.

The kinetic energy K of the rotating flywheel may be described as $K=W \cdot v^2/2\,g$. In this formula, W is flywheel rim weight in pounds; $v=2\pi ND/60$ is a velocity of flywheel at the horizontal centerline of the rim in ft/s; $\pi=3.1416$; N is rotation speed in RPM<; D is the distance of the rim horizontal centerline (i.e., nominal center of gravity of the hub and connected parts) from the center of rotation in feet. From the equation for kinetic energy, it can be seen that the energy increases or decreases by the square of the angular velocity, while only linearly relative to mass.

In scroll compressor operations, the radial compliance is ensured by the orbiting scroll centrifugal force, radial vector component which has to be sufficient to overcome the radial gas forces. But the centrifugal and corresponding radial force of the orbiting scroll member is reduced when the rotational speed has come down below the design level. Analytical and experimental study shows that the radial force will reduce from 75 ft-lb at 3450 RPM to 7 ft-lb at 2600 RPM while radial separation of the orbiting scroll and stationary scroll has been observed at 2600 RPM.

In one specific embodiment for a 40,000 BTU/hr scroll compressor, due to limited space inside of the compressor, we chose a 6.3" diameter steel flywheel having an almost rectangular shaped 0.25" wide×1.5" deep rim. When computing the kinetic energy of the flywheel, the weight of the rim (in our case 1.58 lbs.) is assumed to be concentrated at a horizontal centerline (radius 2.40 in). The kinetic energy stored by such flywheel at 3450 RPM, $K_{3450}=128.095$ ft-lb. At the separation rotational speed (2600 RPM) for the compressor with the flywheel, kinetic energy will be $K_{2600}$= 54.454 ft-lb. The losses of energy stored in the flywheel which has been attached to the compressor motor rotor is due to the gas forces generated by the discharge gas pressure acting upon the orbiting scroll surface, and also the inertia forces and frictional losses. (Assuming that all energy stored by the flywheel as kinetic energy is applied to keep the orbiting and stationary scrolls together and that the stored energy has a lost rate of the order 75% per hour).

In this case, then the kinetic energy of the compressor equipped with the flywheel will be reduced from 128.095 ft-lb to 75 lb-ft (i.e., the radial force level for the compressor without the flywheel at normal operation conditions) in 33 minutes (1,601 lb-ft/min). It means that on any interruption of power, the rotational speed of the compressor orbiting scroll and corresponding radial force will be reduced gradually, thereby preventing reverse rotation and reducing starting torque during short interruptions of the power due to continuous rotation of the motor-rotor.

Flywheel 70 will also aid in removal of heat from motor by directing any compressed fluid or oil running down between air gap 83, stator 24 and rotor 26 toward stator windings 28. This occurs by designing flywheel 70 such that there is a gap 85 between surfaces 80 and 82 and stator windings 28. This gap 85 along with the rotation of flywheel 70 assists in urging or spinning any fluid or oil between rotor 26 and stator 24 out to the inside wall 13 of housing 12.

During operation the oil in sump 36 is protected from blowing up and out in the area around oil pickup tube 38 by means of the flat bottom surface 78 of flywheel 70. Fluid and incoming oil flowing past rotor 26 and stator 24 are directed to either surfaces 80 or 82 due to the rotation of flywheel 70 and caused to be slung against inner wall 13 of compressor housing 12. Any entrained oil particles then flow smoothly down wall 13 into sump 36 with minimal disturbance of oil in oil sump 36.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A compressor comprising:

a housing;

a motor-scroll compressor unit including a fixed scroll, an orbiting scroll member interfit with said fixed scroll, a motor comprising a rotor and a stator, and a crankshaft driven by and connected to said rotor to form a crankshaft/rotor assembly, said motor-scroll compressor unit disposed within said housing, said crankshaft/rotor assembly drivingly connected to said orbiting scroll member, said orbiting scroll member having a particular orbiting direction during operation; and a flywheel attached to said crankshaft/rotor assembly, said flywheel preventing said orbiting scroll member from orbiting in a direction opposite to said particular orbiting direction during compressor shutdown.

2. The compressor of claim 1 in which said flywheel is of sufficient mass to cause pressure equalization within said motor-scroll compressor unit to occur gradually on compressor shutdown.

3. The compressor of claim 1 in which said flywheel is of sufficient mass to prevent autorotation of said orbiting scroll member during intermittent power interruptions.

4. The compressor of claim 1 in which said stator is located relative said rotor to form a gap, said motor-scroll compressor unit causing fluid to flow through said gap and into contact with said flywheel, said flywheel comprising an outwardly extending portion for slinging said fluid past said stator and toward said housing to reduce stator temperature.

5. The compressor of claim 1 further including an oil sump containing oil disposed within said housing, said stator spaced apart from said oil and located relative said rotor to form a gap, said flywheel comprising an outwardly extending portion, said motor-scroll compressor unit causing fluid to flow through said gap and into contact with said flywheel extending portion, said flywheel extending portion slinging said fluid toward said housing whereby disturbance of said oil in said oil sump by said fluid is substantially eliminated.

6. The compressor of claim 1 further including an oil sump containing oil disposed within said housing, said flywheel including a substantially flat bottom surface which rotates opposite said oil sump whereby said oil in said oil sump is protected from disturbances.

7. A compressor comprising:

a housing;

a motor-scroll compressor unit including a fixed scroll, an orbiting scroll member interfit with said fixed scroll, and a motor comprising, a rotor and a stator, said rotor drivingly connected to said orbiting scroll member and disposed within said stator defining an air gap, said orbiting scroll member having a particular orbiting direction during operation, said stator having a bottom surface with an outer radial edge, said motor-scroll compressor unit disposed within said housing causing fluid to flow through said air gap;

an oil sump containing oil is disposed within said housing, said rotor and said stator spaced apart from said oil; and a flywheel comprising an outwardly extending portion, said flywheel attached to said rotor, said flywheel preventing said orbiting scroll member from orbiting during compressor shutdown in a direction opposite to said particular orbiting direction and said flywheel extending portion preventing direct flow of fluid through said air gap to said oil sump.

8. The compressor of claim 7 in which said stator includes an outer radial edge while said flywheel includes an outer radial edge extending radially past said stator outer radial edge whereby any fluid between said rotor and stator is slung by rotation of said flywheel toward said flywheel toward said housing before entering said oil sump.

9. The compressor of claim 8 in which said flywheel is of sufficient mass to cause pressure equalization within said motor-scroll compressor unit to occur gradually on compressor shutdown.

10. The compressor of claim 8 in which said flywheel is of sufficient mass to prevent autorotation of said scroll compressor unit during intermittent power interruptions.

11. The compressor of claim 8 in which said stator is located relative said rotor to form an air gap, said motor-scroll compressor unit causing fluid to flow through said gap and into contact with said flywheel slinging said fluid past said stator and toward said housing to reduce stator temperature.

12. The compressor of claim 8 in which said flywheel includes a substantially flat bottom surface which rotates opposite said oil sump whereby said oil in said sump is protected from disturbances.

13. A compressor comprising:

a housing;

a motor-scroll compressor unit including a motor comprising a rotor and a stator, said rotor having a particular direction of rotation during operation within said stator, said stator having a bottom surface with an outer radical edge, said unit disposed within said housing to compress fluid;

an oil sump containing oil and disposed within said housing, said rotor and said stator spaced apart from said oil;

a flywheel attached to said rotor, said flywheel including a radially extending disk shaped portion having an outer radial edge, said flywheel outer radial edge extending radially past said stator outer radial edge whereby any fluid between said rotor and stator is guided to said housing before entering said oil slump, said flywheel having sufficient mass to prevent said rotor from rotating in a direction opposite to said particular direction of rotation during compressor shutdown.

14. The compressor of claim 13 in which said flywell includes a substantially flat bottom which rotates opposite said oil sump whereby said oil in said oil sump is protected from disturbances.

15. The compressor of claim 13 in said flywheel is of sufficient mass to prevent autorotation of said scroll compressor unit during intermittent power interruptions.

16. A compressor comprising;

a housing;

a motor-scroll compressor unit including an orbiting scroll member, and a motor comprising a rotor and a stator, said rotor drivingly connected to said orbiting scroll member, said orbiting scroll member having a particular direction of rotation during operation, said motor-scroll compressor unit disposed within said housing;

an oil sump containing oil and disposed within said housing, said rotor and said stator spaced apart from said oil; and a flywheel attached to said rotor, said flywheel preventing said rotor from rotating in a direction opposite to said particular direction of rotation during compressor shutdown.

* * * * *

UNITED STATES PATENT AND TRADEMARK OFFICE

CERTIFICATE OF CORRECTION

PATENT NO. : 5,498,143

DATED : March 12, 1996

INVENTOR(S) : Nelik I Dreiman et al

It is certified that error appears in the above-indentified patent and that said Letters Patent is hereby corrected as shown below:

Claim 8, column 6, line 45, delete "said flywheel toward", second occurrence.

Claim 13, column 7, line 2, delete "radical" and substitute therefor --radial--.

Claim 13, column 7, line 12, delete "slump" and substitute therefor --sump--.

Claim 14, column 7, line 17, delete "flywell" and substitute therefor --flywheel--.

Claim 14, column 7, line 18, after "bottom" insert --surface--.

Signed and Sealed this

Twenty-fifth Day of June, 1996

*Attest:*

Bruce Lehman

BRUCE LEHMAN

*Attesting Officer*

*Commissioner of Patents and Trademarks*